US006286421B1

(12) United States Patent
Ackley

(10) Patent No.: US 6,286,421 B1
(45) Date of Patent: Sep. 11, 2001

(54) METHOD AND APPARATUS FOR SPIN PRINTING INDICIA ON PELLET SHAPED ARTICLES

(75) Inventor: E. Michael Ackley, Stone Harbor, NJ (US)

(73) Assignee: Ackley Machine Corporation, Morrestown, NJ (US)

( * ) Notice: Subject to any disclaimer, the term of this patent is extended or adjusted under 35 U.S.C. 154(b) by 0 days.

(21) Appl. No.: 09/059,205

(22) Filed: Apr. 14, 1998

(51) Int. Cl.[7] ..... B41F 17/08
(52) U.S. Cl. ..... 101/38.1; 101/35
(58) Field of Search ..... 101/35, 36, 37, 101/38.1, 39, 40

(56) References Cited

U.S. PATENT DOCUMENTS

| | | | | |
|---|---|---|---|---|
| 3,552,311 | * | 1/1971 | Petri | 101/148 |
| 3,868,900 | | 3/1975 | Ackley . | |
| 3,869,981 | * | 3/1975 | Davis | 101/91 |
| 3,871,295 | | 3/1975 | Ackley . | |
| 3,889,591 | | 6/1975 | Noguchi . | |
| 3,889,595 | | 6/1975 | Jaffa . | |
| 3,931,884 | | 1/1976 | Ackley . | |
| 4,069,753 | | 1/1978 | Ackley et al. . | |
| 4,104,966 | | 8/1978 | Ackley, Jr. et al. . | |
| 4,167,226 | | 9/1979 | Ackley et al. . | |
| 4,208,962 | | 6/1980 | Ackley, Sr. et al. . | |
| 4,231,462 | | 11/1980 | Ackley, Sr. et al. . | |
| 4,254,704 | | 3/1981 | Ackley, Sr. et al. . | |
| 4,266,477 | | 5/1981 | Ackley . | |
| 4,266,478 | | 5/1981 | Ackley . | |
| 4,327,825 | | 5/1982 | Ackley, Sr. et al. . | |
| 4,335,810 | | 6/1982 | Ackley et al. . | |
| 4,353,456 | | 10/1982 | Yamamoto . | |
| 4,369,702 | | 1/1983 | Ackley . | |
| 4,372,437 | | 2/1983 | Ackley, Sr. et al. . | |
| 4,377,971 | | 3/1983 | Ackley . | |
| 4,393,973 | | 7/1983 | Ackley, Sr. et al. . | |
| 4,394,933 | | 7/1983 | Ackley . | |
| 4,413,556 | | 11/1983 | Ackley . | |
| 4,437,559 | | 3/1984 | Ackley, Sr. et al. . | |
| 4,479,573 | | 10/1984 | Ackley, Sr. et al. . | |
| 4,500,012 | | 2/1985 | Ackley . | |
| 4,632,028 | | 12/1986 | Ackley . | |
| 5,376,771 | | 12/1994 | Roy . | |
| 5,476,043 | * | 12/1995 | Okuda et al. | 101/483 |
| 5,485,665 | * | 1/1996 | Marks et al. | 29/407 |

FOREIGN PATENT DOCUMENTS 0 324 046 1/1988 (EP) .

* cited by examiner

*Primary Examiner*—Ren Yan
(74) *Attorney, Agent, or Firm*—Oliff & Berridge, PLC

(57) ABSTRACT

A method and apparatus orient, position and spin print indicia on pellet shaped articles, such as pharmaceutical capsules and the like. More specifically, the method and apparatus use a rotating pick-up drum that receives and transports the pellet shaped articles to a rotating positioning drum that is synchronized with the pick-up drum. The positioning drum receives the pellet shaped articles from the pick-up drum and properly aligns the pellet shaped articles so that they may be transferred to a rotating printing drum which is also synchronized with the positioning drum. The printing drum contains a vacuum source that maintains the pellet shaped articles within pockets as the pellet shaped articles are passed through a printing station. The printing station contains a movable printing roller capable of being moved toward and away from the printing drum such that the printing roller accurately spin prints indicia onto the pellet shaped articles. A servo controller unit is connected to the apparatus and is configured to control, among other features of the apparatus, the rotation speed of the drums, but also the precise location of the printing roller in relationship to the rotating printing drum.

25 Claims, 10 Drawing Sheets

METHOD AND APPARATUS FOR SPIN PRINTING INDICIA ON PELLET SHAPED ARTICLES

BACKGROUND OF THE INVENTION

1. Field of Invention

This invention relates generally to a method and apparatus for orienting, positioning and spin printing indicia on pellet shaped articles, such as pharmaceutical capsules and the like. More specifically, the invention relates to a method and apparatus in which a conveyer transports the pellet shaped articles to a rotating printing drum that maintains the pellet shaped articles within pockets as the pellet shaped articles are passed through a printing station. The printing station has a movable printing roller capable of being moved toward and away from the printing drum or vice versa such that the printing roller accurately spin prints indicia onto the pellet shaped articles. A servo controller unit is connected to the apparatus and is configured to control the location of the printing roller with respect to the rotating printing drum to adjust the amount of indicia transferred to the pellet shaped articles.

2. Description of Related Art

The concept of providing solid medication in unit doses for oral consumption is well known and commercially available wherever pharmaceutical products are sold. The medicinal compounds are packaged for consumption in various well known forms, such as tablets, caplets, capsules and others. The present invention is generally concerned with the orienting, rectifying, and precision spin printing of indicia onto pellet shaped articles.

The capsule is known as a common method of packaging medicinal compounds and other materials suitable for ingestion. Typically, the capsule is a two-part pellet shaped article having telescoping cap and body portions of predetermined size and configuration to hold the medicine therein, while caplets are shaped like capsules, but are one piece. Standard practice in the packaging of capsules is to imprint certain indicia over the surface of the capsules. The name of the manufacturer or the batch number from which the medicinal compound has been derived, or other information which may be required by the Food and Drug Administration, or other government agencies, are examples of the types of indicia found on capsules. The indicia can be imprinted onto the capsules by a technique known in the art as spin printing.

Spin printing is carried out by rotating the capsule on its longitudinal axis as indicia is printed on the surface of the capsule. Preferably, the capsules will be uniformly oriented or rectified before reaching the printing station. At the printing station, the capsules are then uniformly rotated in a manner which allows for rotation of the capsule without any substantial slippage between the imprinting head and the capsule surface, whereby a sharp, precise, printing indicia is produced on each capsule as it passes through the printing station.

Numerous methods and machines have been developed to spin print indicia onto pellet shaped articles, such as pharmaceutical capsules, food products, and the like. In general, there are two types of methods and corresponding apparatuses for spin printing. The first apparatus and method spin prints pellet shaped articles using a flat type carrier apparatus, e.g., conveyor belt, while the second apparatus and method spin prints onto the pellet shaped articles using rotating drums or cylinders.

The conveyor belt type spin printing apparatus, as shown in U.S. Pat. No. 3,871,295, for example, typically includes a feeding station 20, a transporting and rectifying member 21, a conveyance system 31, and a spin printing unit 41. The feeding station 20 usually comprises a gravity feed hopper located above the transporting member 21 and is designed to frictionally feed randomly ordered articles C into cavities 24 of the transporting member 21 in an orderly manner. The transporting member 21, which usually provides at least one rotating drum having a plurality of peripherally spaced cavities, rectifies the pellet shaped articles C while they are still in the cavities and deposits them in a predetermined and uniform manner onto the conveyance system 31.

The conveyance system, as shown in U.S. Pat. No. 4,632,028 for example, typically includes a carrier bar 45 having pockets 52 for holding the deposited articles 2 therein. The carrier bars 45 are conventionally composed of a slippery material, such as, for example, polytetraflouroethylene, having a coefficient of friction which is less than that of the printing roll in the spin printing unit. This composition allows the pellet shaped articles 2 to rotate freely upon their longitudinal axis when subjected to the frictional influence of the printing roll during the spin printing process. Before the articles are transported through the spin printing unit, some of the conveyor belt type spin printing devices use an apparatus for spacing apart the cap and body portions of the article to a limited degree in order to provide an enlarged and exact overall length for each pellet shaped article, thereby preparing each article for the spin printing operation.

For example, in U.S. Pat. No. 3,868,900, the cap and body portions are separated by using an air jet 72, known in the industry as an air separator. Once the articles are prepared for spin printing, they are transported further downstream to a spin printing unit. The conventional conveyor belt type spin printing unit also comprises an ink reservoir which applies ink to an etched roll. The etched roll transfers the indicia to a rubber printing roll which prints indicia onto each article as it passes through the printing unit while on the conveyance system.

Examples of the conveyor belt type of spin printing apparatus are disclosed in U.S. Pat. Nos. 3,868,900 to Ackley; 3,871,295 to Ackley; 3,931,884 to Ackley; 4,069,753 to Ackley, deceased et al.; 4,104,966 to Ackley, Jr. et al.; 4,167,226 to Ackley, decreased et al.; 4,254,704 to Ackley, Sr. et al.; 4,266,477 to Ackley; 4,335,810 to Ackley, deceased et al.; 4,372,437 to Ackely, Sr. et al.; 4,413,556 to Ackley; 4,479,573 to Ackley, Sr. et al.; and 4,632,028 to Ackley.

The rotating drum type spin printing apparatus, as shown in U.S. Pat. No. 4,377,971 for example, typically includes a feeding station, a plurality of rotating drums and a spin printing station. The feeding station 1 is similar to the one described in conjunction with the conveyor belt type spin printer and will not be discussed here. The rotating drums and usually comprise at least two, and sometimes additional rotating drums. The first rotating drum 5, or transfer drum, receives the randomly ordered pellet shaped articles 3 into a plurality of peripherally spaced pockets 9 shaped and sized in a manner well known in the art to receive and carry individual pellet shaped articles 3. In general, a vacuum source 83 retains the pellet shaped articles 3 in the pockets 9 while a rotary brush 17 sweeps away any pellet shaped article 3 that may be overlapping the article-filled pocket. An arcuate sizing block and back guide 23, which is positioned circumferentially over the transfer drum 5 downstream of the feeding station 1 and upstream of the other drum 46, facilitates the rectifying of the pellet shaped articles 3 while in the peripherally spaced pocket 9 so that they are radially aligned within the pockets 9 of the transfer drum 5. Optionally, once the pellet shaped articles 3 are rectified, an air check may help to move the pellet shaped articles from the feed drum 5 to a second, or cam drum 46.

As shown in U.S. Pat. No. 3,889,591 for example, the second rotating drum 18 may also retain the pellet shaped articles T in peripherally spaced pockets 17*a* using a vacuum source 29. As mentioned with the transfer drum above and shown in U.S. Pat. No. 4,394,933 having three rotating drums, the second rotating drum 36 may also have a sizing block and back guide 44 that is positioned circumferentially over the second rotating drum 36 downstream of the transfer drum and upstream of the other drum, to facilitate the orienting of the pellet shaped articles 12 so that they are longitudinally aligned within the pockets 38 of the second rotating drum 36. The longitudinally aligned articles 12 are then transferred to a rotating printing drum 52.

The printing drum 52 maintains the pellet shaped articles 12 within peripherally spaced pockets 50*a* and rotates the articles 12 through a printing unit 58 where they are spin printed upon. It should be noted that while in the printing drum, the articles have been known to be held in place by a vacuum source. By keeping the pellet shaped articles in place, the vacuum source controls the amount the articles spin when they come into contact with the print roller. Since the print roller is rotating faster than the drum, the article "spins" in its pocket, thereby printing some indicia on the article. The spin printed articles are then discharged from the apparatus for further processing. Examples of the rotating drum type of spin printing apparatus are disclosed in U.S. Pat. Nos. 3,889,591 to Noguchi; 4,266,478 to Ackley; 4,369,702 to Ackley; 4,377,971 to Ackley; and 4,394,933 to Ackley.

Unfortunately, both types of spin printers suffer from drawbacks. One drawback to these types of spin printing devices is that there is no mechanism to accurately control the amount of pressure that is applied from the printing roll to the rotating article. Therefore, the existing types of spin printers apply too much or too little pressure to the article. When too much pressure is applied, the article rotates too fast within the pocket, and as such, will contact the printing roll an undesirable additional number of times. This relationship is known in the industry as kiss-back, which results in uneven and undesired indicia being printed onto the article. As a solution to this problem, some manufacturers cut-away the non-indicia transferring region of the printing roll to prevent kiss-back from occurring. However, this approach has proven to be too costly and results in the cut-away portion of the roll being wasted. An additional drawback is that the printing roll must be changed for different indicia logos. Also, because the above-described types of spin printing devices are not capable of controlling the amount of pressure applied to the article, the devices cannot print a band of indicia completely around the article such that the ends of the indicia bands are registered. Further, conventional spin printers have the drums and printing roller geared to one another, which does not allow for the relative speed changes. At present, the current spin printing apparatuses are capable of printing a band of indicia on the article encompassing approximately 310° to 320° around the article. In addition, existing spin printing apparatuses are incapable of adjusting the speed of rotation of the printing roller relative to the printing drum, the amount of pressure applied to the articles from the printing roller, the location of the printing roller and articles relative to each other and/or the amount of indicia applied to the articles "on the fly," or in other words, while the apparatus is operating.

SUMMARY OF THE INVENTION

It is an object of the invention to provide a spin printing apparatus and method for accurately spin printing indicia on pellet shaped articles.

It is another object of the invention to provide a spin printing apparatus and method that is capable of marking the pellet shaped articles or capsules completely around the objects such that the ends of the indicia bands meet.

In order to achieve the above, and to overcome the shortcomings in the aforementioned related art, a spin printing method and apparatus according to a preferred embodiment of the invention includes a conveyor and a printing roller. The conveyor has a plurality of pockets that receive a plurality of pellet shaped articles. The printing roller is spaced a predetermined distance from the conveyor and prints indicia on each of the pellet shaped articles. The apparatus further includes a device that adjusts the predetermined distance to change the amount of indicia that is printed onto the pellet shaped articles. Optionally, the conveyor may have a pocket for receiving a pellet shaped article.

Preferably, the conveyor includes a printing drum rotatably communicating with the printing roller. The printing drum has a vacuum source that maintains the pellet shaped articles within a plurality of pockets by drawing air into the pockets such that the pellet shaped articles are maintained in the pockets. The pellet shaped articles are spin printed upon as they pass the printing roller. Optionally, a feeding station may be configured to distribute the pellet shaped articles onto the printing drum before they are spin printed.

The conveyor of the apparatus may further include a pick-up drum and a positioning drum. Each drum would also have a plurality of pockets that receive the plurality of pellet shaped articles. The pick-up drum rotatably communicates with and receives the pellet shaped articles from a feeding station, while the positioning drum rotatably communicated with and received the pellet shaped articles from the pick-up drum. As such, the printing drum would then rotatably communicate with and receive the pellet shaped articles from the positioning drum.

A design roller, defining a pattern of indicia, is in constant contact with the printing roller. The printing roller is positioned between the design roller and the printing drum and rotatably communicates with both. As such, because the printing roller has a smooth, blank surface, the printing roller transfers the pattern of indicia from the design roller to the pellet shaped articles, which are held in the printing drum. In addition, the printing roller is movable toward and away from the printing drum.

Alternatively, the device could be a servo controller unit that is connected to the printing roller such that the servo controller unit controls the precise location of the printing roller with respect to the conveyor or printing drum. By adjusting the distance of the printing roller from the conveyor, when the printing roller is positioned closer to the conveyor, the amount of indicia printed on the pellet shaped articles increases. Contrarily, when the printing roller is positioned farther from the conveyor, the amount of indicia printed on the pellet shaped articles decreases. The design roller and associated ink pan can be designed to move with the printing roller.

Optionally, the servo controller unit can also control the location of the conveyor with respect to the printing roller. Therefore, when the conveyor is positioned closer to the printing roller, the amount of indicia printed on the pellet shaped articles increases, and when the conveyor is positioned farther from the printing roller the amount of indicia printed on the pellet shaped articles decreases.

The resulting apparatus selectively spin prints indicia onto each of the pellet shaped articles encompassing a range of 0° to 360° of the circumference of the pellet shaped articles.

In another embodiment, an apparatus has a conveyor, a printing roller that provides a predetermined amount of indicia to the pellet shaped articles under a selected force and a servo controller unit that adjusts the selected force to change the predetermined amount of indicia provided onto the pellet shaped articles. The apparatus includes a printing drum, pick-up drum, positioning drum, and design roller.

The servo controller unit can control the precise location of the printing roller with respect to the conveyor or printing drum such that the selected force applied to the pellet shaped articles can be adjusted. Therefore, when the printing roller is positioned closer to the printing drum, the selected force provided to the pellet shaped articles increases and the amount of indicia provided from the printing roller to the pellet shaped article also increases. When the selected force is decreased, the amount of indicia provided from the printing roller to the pellet shaped article will also decrease.

Optionally, the servo controller unit can be connected to the conveyor to control the precise location of the conveyor with respect to the printing roller. As such, the servo controller can adjust the selected force provided to the pellet shaped articles from the printing roller. By positioning the conveyor closer to the printing roller, the amount of indicia provided from the printing roller to the pellet shaped article increases because the selected force is increased. In addition, when the conveyor is moved away from the printing roller, the selected force is decreased and the amount of indicia provided to the pellet shaped article also decreases.

In yet another embodiment, an apparatus has a printing roller that frictionally engages the pellet shaped articles to selectively print a standard amount of indicia along the entire circumference of the capsule. The apparatus has a conveyor and servo controller unit that adjusts the amount the printing roller frictionally engages the pellet shaped articles.

In another embodiment, an apparatus has a printing roller having a predetermined rate of rotation to selectively spin print indicia along an entire circumference of the pellet shaped articles. The apparatus also has a servo controller unit or any other suitable variable drive device that adjusts the rate of rotation of the printing roller, for example, relative to the associated printing/position drums, to change the amount of indicia spin printed on the pellet shaped articles. The conveyor may include a pick-up drum, positioning drum and printing drum that are synchronized with each other and rotate at a rate slower than the printing roller.

The servo controller unit may control the precise location of the printing roller with respect to the conveyor and/or the rate of rotation of the printing roller. So, when the printing roller is moved closer to the printing drum, the amount of indicia spin printed on the pellet shaped articles increases, and when the printing roller is moved away from the conveyor, the amount of indicia spin printed on the pellet shaped articles decreases. Also, when the rate of rotation of the printing roller is increased, the amount of indicia spin printed onto the pellet shaped articles increases.

Preferably, the spin printing is accomplished with a smooth, blank printing roller that rotatably communicates with the design roller. Since the design roller defines a pattern of indicia on its circumference, the printing roller transfers the indicia on the design roller to the pellet shaped articles.

The resulting apparatus and method accurately spin prints indicia onto pellet shaped articles. In addition, the band of indicia printed on the articles may completely surround the article if desired, thereby providing a pleasing appearance not previously possible and the consumer with more information as to the nature of the contents within the article that they are consuming.

These and other objects of the invention will be described in or apparent from the following description of preferred embodiments.

BRIEF DESCRIPTION OF THE DRAWINGS

Preferred embodiments of the invention will be described in conjunction with the following drawings in which like reference numerals designate like elements and wherein.

DETAILED DESCRIPTION OF PREFERRED EMBODIMENTS

Figure 1:
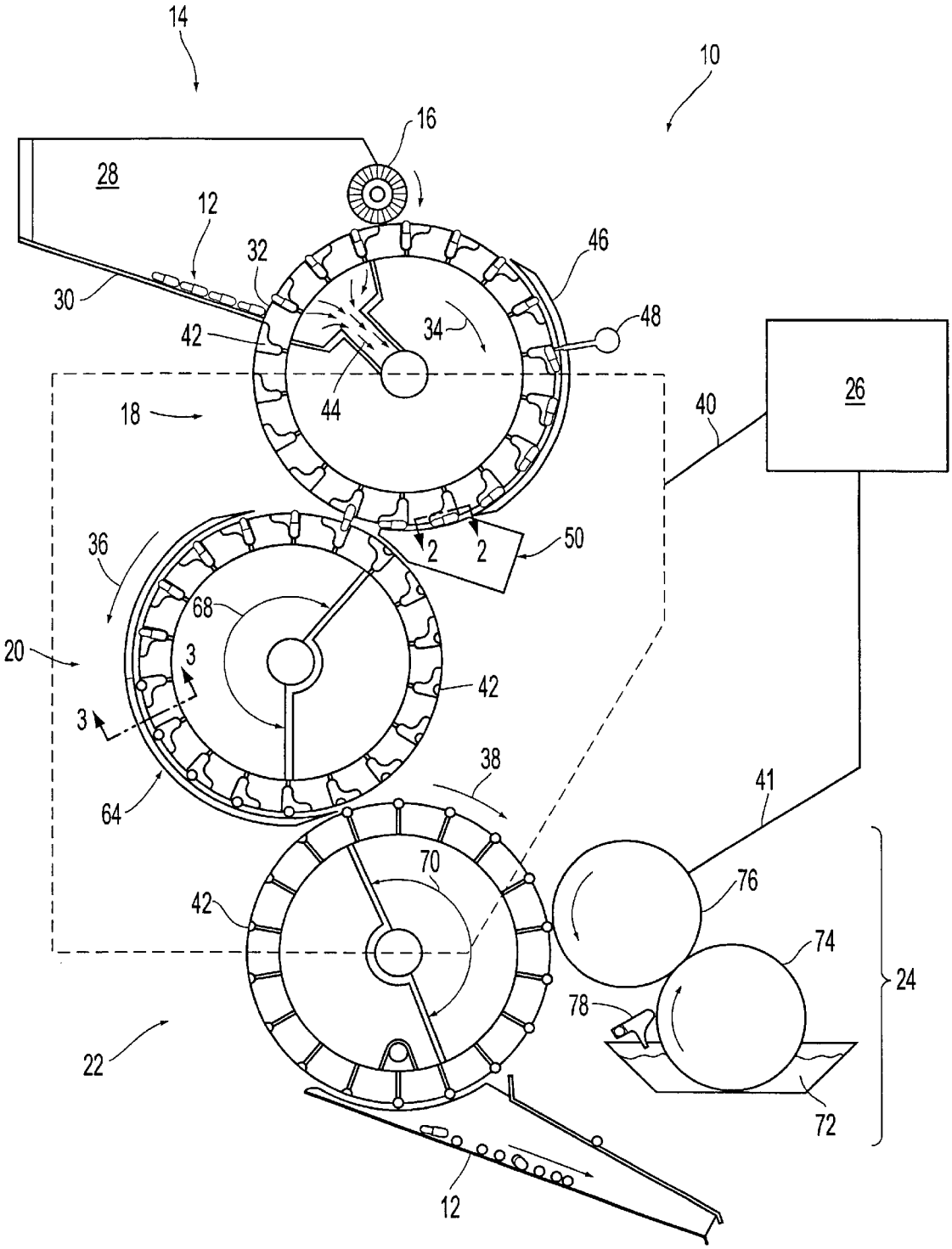
FIG. 1 is a cross-section view of the spin printing apparatus for printing indicia on pellet shaped pharmaceutical articles.

FIG. 1 is a perspective view of an apparatus 10 for accurately spin printing indicia onto pellet shaped pharmaceutical articles 12 such as, for example, capsules. The apparatus 10 includes, for example, a feeding station 14, a rotary brush 16, a pick-up drum 18, a positioning drum 20, a printing drum 22, a printing station 24, and a servo controller unit 26 or other suitable controller. The pick-up drum 18, positioning drum 20, and pick-up drum 22 rotate and are synchronized with each other to effectively and efficiently orient and rectify a plurality of randomly ordered articles 12 for spin printing.

Figure 9:
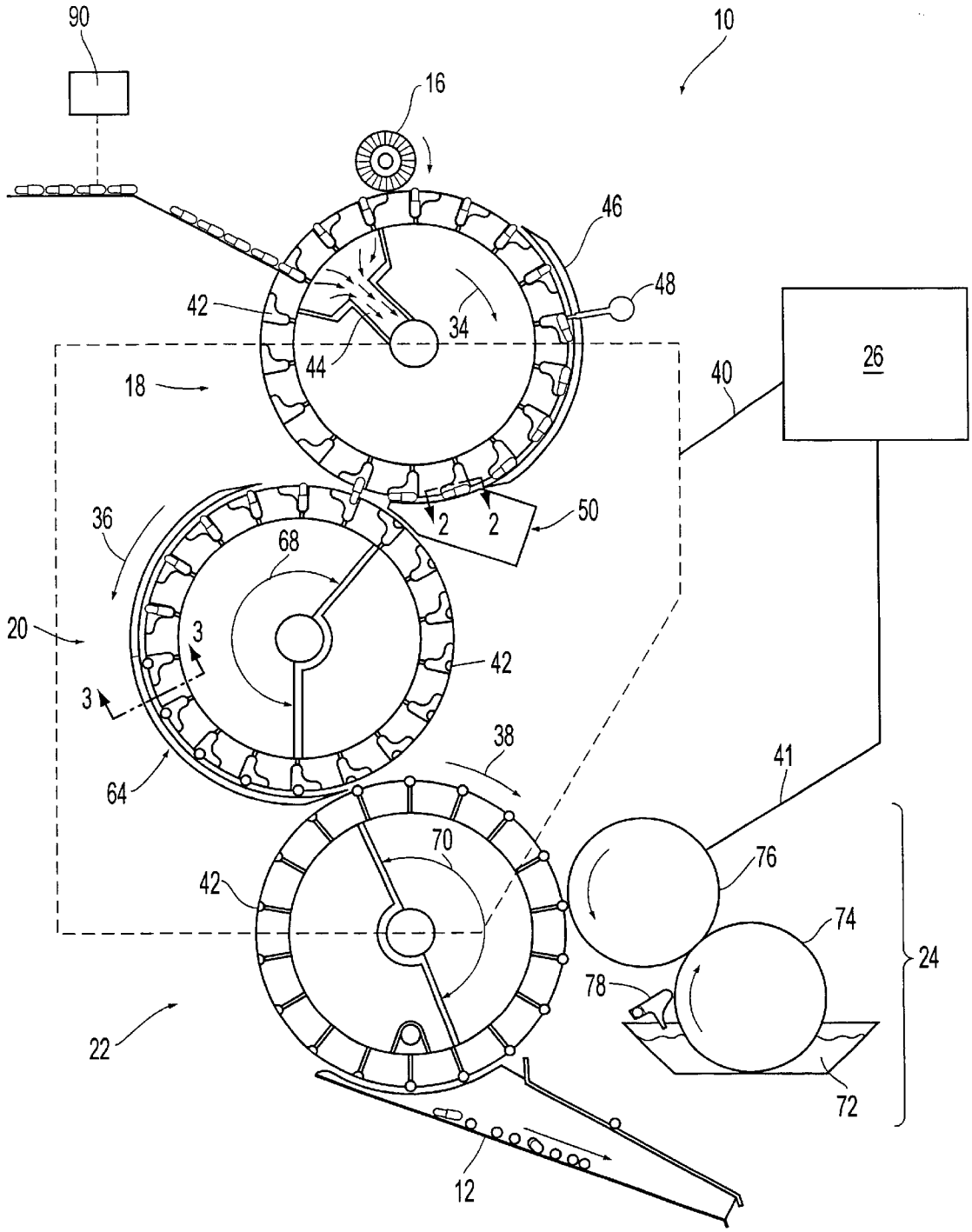
FIG. 9 is a perspective view of the spin printing apparatus in a third embodiment according to the invention.

The feeding station 14 is mounted upon a suitable support (not shown) and includes, e.g., a hopper 28 having an inclined bottom 30 terminating at an article opening 32 that feeds the randomly ordered pellet shaped articles 12 one at a time into the pick-up drum 18. As can be seen in FIG. 1, the inclined bottom 30 is designed to radially feed the articles 12 into the pick-up drum 18. It should be noted that the inclined bottom 30 may also be designed to feed the pellet shaped articles 12 longitudinally (not shown) into the pick-up drum 18 to have the feeding station 14 be a flat conveyer (not shown). It is also within contemplation of the invention to have the feeding station 14 be a flat conveyor as shown in FIG. 9.

The pick-up drum 18 is rotated by its shaft in a direction indicated by the arrow 34. The positioning drum 20 rotates in a substantially tangential relationship below the pick-up drum 18 in the direction of the arrow 36 upon rotation of its shaft. The printing drum 22 also rotates in a substantially tangential relationship beneath the positioning drum 20 in the direction of the arrow 38 upon rotation of its affixed shaft. The servo controller unit 26 is connected to the apparatus and may include, for example, among other features, a timing belt (not shown), gear train (not shown) and servo motor (not shown) arranged in a manner known in the industry to allow the servo controller unit 26 to control the rotation speed of the drums. Thus, the servo controller unit 26 controls the rotation speed of all of the drums such that the drums have the same rotation speed.

The articles 12 are radially fed from the hopper 28 to the pick-up drum 18 into pockets 42 on the periphery of the pick-up drum 18. The pockets 42 are sized and shaped to receive individual articles 12 therein. A vacuum source 44, which may or may not be controlled by the servo controller 26, can be provided to draw the individual articles 12 snugly into each pocket 42 and a hopper brush 16 sweeps away any articles 12 that may be overlapping an occupied pocket 42. Once any overlapping articles 12 have been swept away by the hopper brush 16, the vacuum source 42 is terminated and the articles 12 are maintained in their respective pockets 42 by gravity and/or an arcuate sizing block and back guide 46. The positioning drum 20 and printing drum 22 may also include internal vacuum sources 68 and 70, respectively.

The arcuate sizing block and back guide 46, positioned circumferentially over the pick-up drum 18 downstream of the hopper 28 and upstream of the positioning drum 20, initiates alignment of the pellet shaped articles 12 so that they may eventually be rectified in a uniform radial alignment within the pockets 42 of the pick-up drum 18. An air jet 48 is located proximate the top of the back guide 46 to help dislodge the articles 12 from the pockets 42 so that they may be eventually rectified properly.

Figure 2:
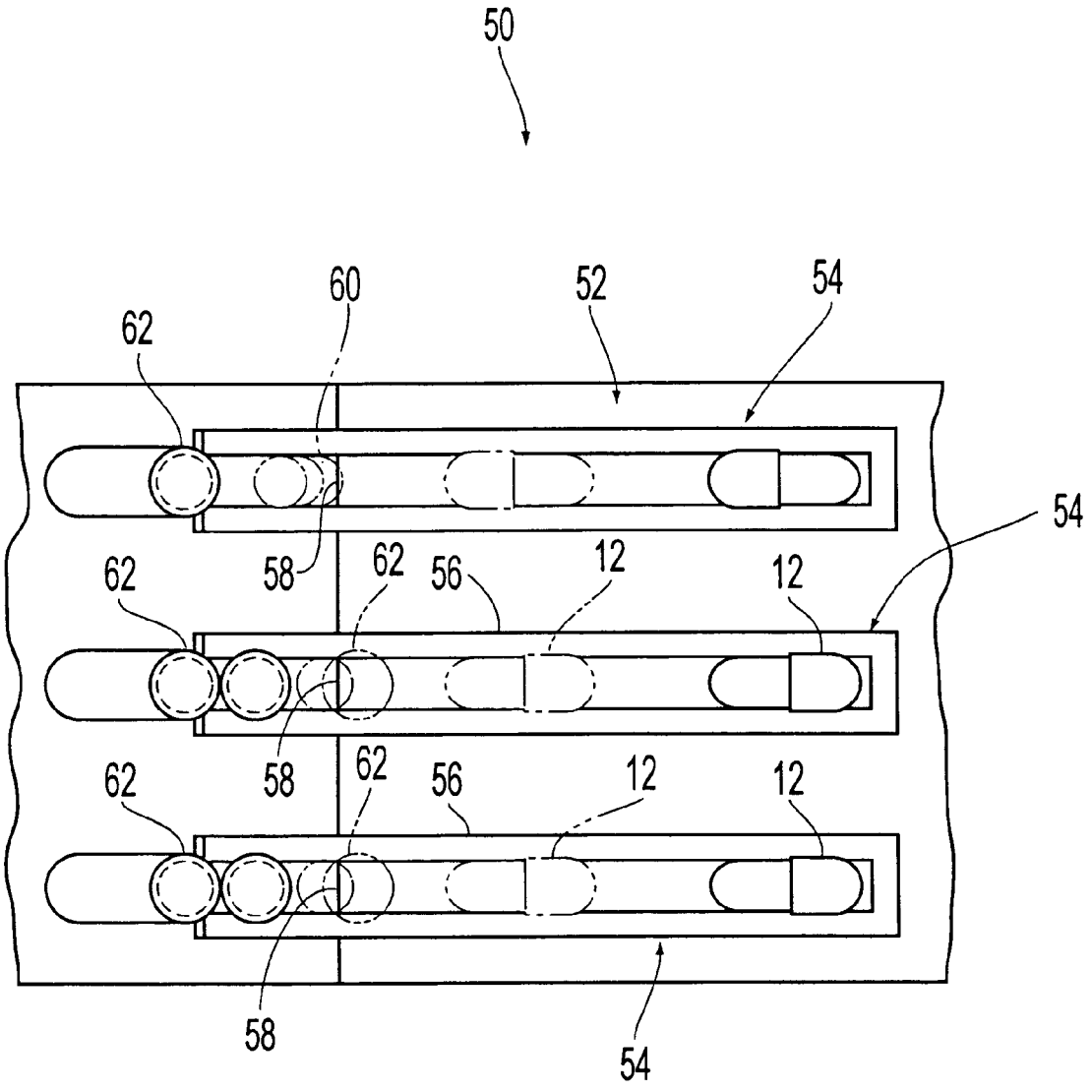
FIG. 2 is a cross-sectional view of the apparatus illustrated in FIG. 1, as viewed along line 2—2, showing the article rectifier.

With reference to FIG. 2, the base of the pick-up drum 18 is provided with a rectifier 50, which generally includes a guide 52 incorporating one or more channels 54. Each channel 54 of the guide 52 is in alignment with each row of pockets 42 on the periphery of the pick-up drum 18. In the example shown, three rows are provided, but more or less rows are obviously within contemplation. Each of the channels 54 is defined by spaced walls 56 which project from the terminating edge 58 of the guide 52 so that the end of each channel 54 is open at the bottom.

The channels 54 are configured to have a width designed to receive the body portion 60 of the article 12, but not the cap portion 62. Therefore, any article 12 which is contained in the peripheral portion of a pocket 42, such that the body portion 60 leads the cap portion 62, will be received within the guide 52 so the article 12 can rotate about a horizontal axis within the channel 54, such that the article 12 is suspended between the walls 56 of the channel 54 by its cap portion 62. Articles 12 that are contained in the peripheral portion of a pocket 42 such that the cap portion 62 leads the body portion 60 will proceed along the channel 54 until the body portion 60 is drawn beyond the edge of the guide 52, whereupon such articles 12 will also rotate about a horizontal axis within the channel 54, so that the article 12 is again suspended from the walls 56 of the channel 54 by its cap portion 62. After traversing the guide 52, the articles 12 are then delivered to a positioning drum 20 in uniform radial alignment.

Returning to FIG. 1, the radially aligned articles 12 are then transferred to a rotating positioning drum 20 that is synchronized with the pick-up drum 18. The positioning drum 20 also has a plurality of peripherally spaced pockets 42 sized and shaped to receive and transport the individual pellet shaped articles 12. As can be seen in FIG. 1, the articles 12 are received in a radial position by the pockets 42 of the positioning drum 20.

Figure 3:
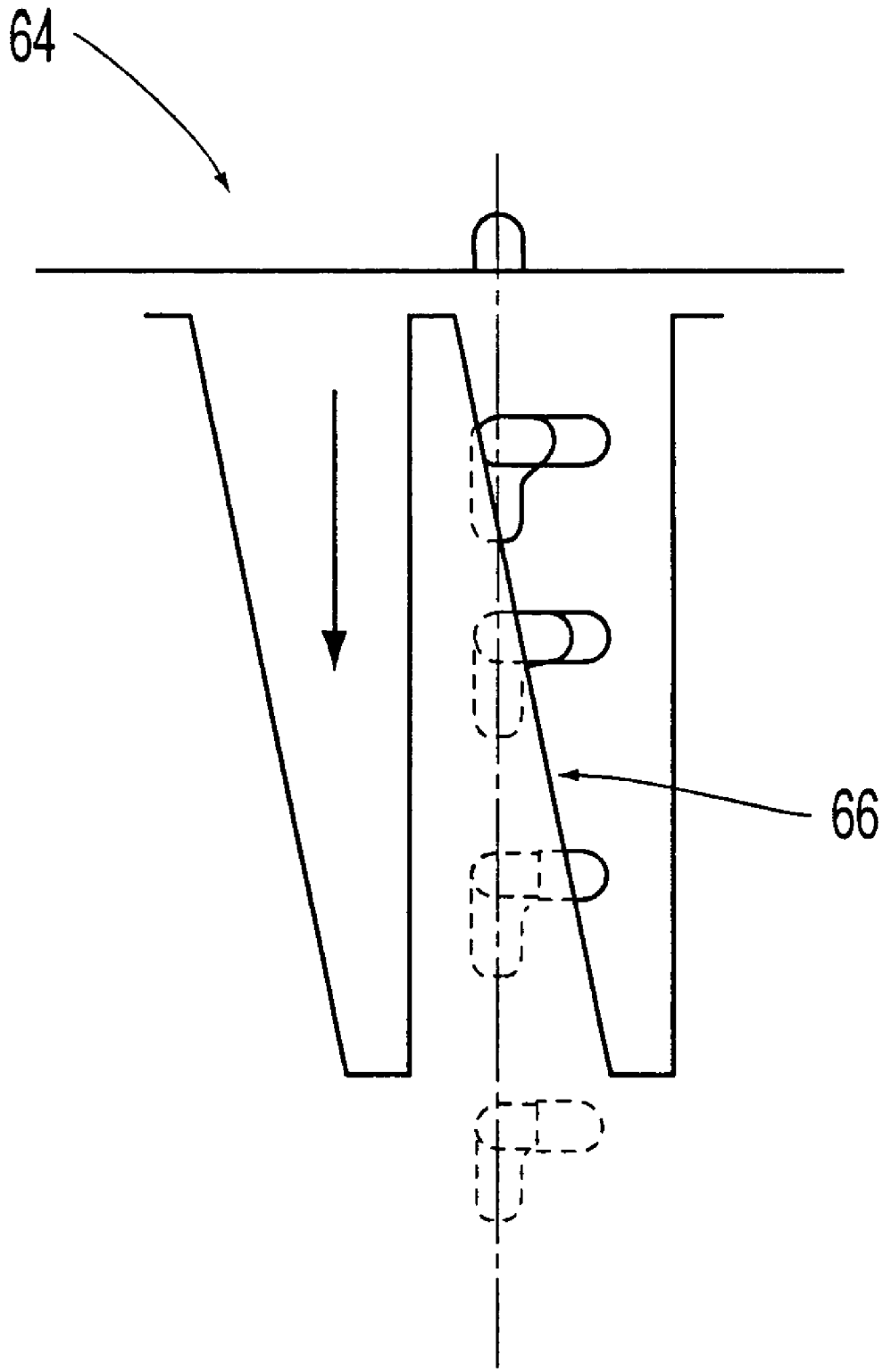
FIG. 3 is a cross-sectional view of the apparatus of FIG. 1, as viewed along line 3—3.

As shown in FIG. 3, a cam edge 64, having a back guide with cam track 66 and being positioned circumferentially over the positioning drum 20 downstream of the pick-up drum 18 and upstream of the printing drum 22, orients the articles 12 so that they are longitudinally aligned within the pockets 42 of the positioning drum 20. A vacuum source 68 and/or gravity retains the articles 12 within the individual pockets 42 from when they are deposited from the pick-up drum 18 to the positioning drum 20 to when the articles 12 are dislodged and transferred to the printing drum 22. As the positioning drum 20 rotates, the vacuum source 68 maintains the radially aligned articles 12 within their respective pockets 42. As can be seen in FIG. 3, when the articles 12 engage the cam edge 64, the cam track 66 manipulates the articles 12 from a radial alignment to a longitudinal alignment so that indicia may be imprinted upon the circumferential surface of the article. Once the articles 12 have been longitudinally aligned, they are deposited within the peripherally spaced pockets 42 of the rotating printing drum 22 that is synchronized with the positioning drum 20.

The printing drum 22 receives the longitudinally aligned articles 12 within the pockets 42 which are maintained therein by a vacuum source 70. The vacuum source 70 retains the articles 12 within the pockets 42 as they pass through the spin printing station 24.

The spin printing station 24 generally includes an ink pan 72 having a design or gravure roller 74 rotating therein and a movable printing roller 76 positioned between the design roller 74 and the rotating printing drum 22. The design roller 74 has a logo etched onto its peripheral surface such that when the servo controller unit 26 manipulates the printing roller 76 to be in simultaneous contact with the design roller 74 and the printing drum 22, ink is transferred from the design roller 74 to the printing roller 76. A doctor blade 78 is positioned between where the design roller 74 picks up the ink and transfers it to the printing roller 76 to remove any excess ink. The printing roller 76 may be blank in that there would be no logos or other indicia permanently etched onto the roller 76. This would allow the same printing roller 76 to be used for subsequent jobs having different indicia. The design roller 74, being in contact with the printing roller 76, transfers the ink to the printing roller 76 so that it can be printed onto the pellet shaped articles 12 maintained in the peripherally spaced pockets 42 of the printing drum 22.

Because the vacuum source 70 uses a constant holding pressure to maintain the articles 12 within their respective pockets 42 of the rotating printing drum 22, the servo controller unit 26 dictates the amount of ink imprinted onto the articles 12 by controlling the positioning of the printing roller 76 relative to the design roller 74 and the rotating printing drum 22 such that the amount of impression, or contact, between the printing roller 76 and the printing drum 22 directly correlates to the length of the band of indicia imprinted onto the articles 12. The relationship between the design roller 74, printing roller 76 and printing drum 22 is such that the further inward the printing roller 76 is positioned, i.e., closer to the printing drum 22 and farther from the design roller 74, the more ink that will get printed onto the article. This is due to the fact that the amount of frictional pressure applied to the article from the printing roller 76 will increase, resulting in the pellet shaped article 12 spinning more within the pocket 42 as it is being maintained therein by the vacuum source 70.

Conversely, the further outward the printing roller 76 is positioned, i.e., closer to the design roller 74, and further from the rotating printing drum 22, a smaller amount of ink is printed onto the article because the article 12 will spin less because less pressure is applied to the article 12 and the circumference needed to be traversed by the printing roller 76 is larger. Of course, the design roller 74 and/or ink pan 72 can move with the printing roller 76 to maintain contact between the design roller 74 and the printing roller 76.

The servo controller unit 26 may also be programmed to coordinate relative movement between the printing drum and printing roller based on the printing cycle of the system. The servo controller unit 26 or any other suitable controller would be capable of moving the printing drum and roller toward one another during printing, and to move them away from each other during non-printing periods, which also prevents a solution to "kiss-back". The cycling can be effected by, for example, software programming and/or mechanical device such as a cam mechanism.

Referring back to FIG. 1, it can be understood that the servo controller unit 26 may be connected 40 to the pick-up drum 18, positioning drum 20 and printing drum 22 electrically, mechanically, digitally or by any other known method. As such, the servo controller unit 26 can be used for adjusting the timing the transfer of the pellet shaped articles 12 from the pick-up drum 18 to the positioning drum 20. By adjusting the speed of the rotating drums, the servo controller unit 26 allows the apparatus to handle various types of pellet shaped articles consistently. For example, if the apparatus 10 completes a job spin printing large articles and is going to handle smaller articles on a subsequent job, the servo control unit 26 can adjust the speed of the rotating drums to take into account the characteristics of articles to be spin printed during the subsequent job. As such, the servo controller unit 26 is used for adjusting the set up or home position of the pick-up drum 18 as well as setting the speed of the apparatus 10. It is also within contemplation that the servo controller unit 26 may be connected to only selected ones, e.g., less than all of the rotating drums. For example, the servo controller unit 26 may be connected to just the pick-up drum where the remaining drums would be controlled by the pick-up drum 18 in a master/slave relationship.

Figure 4:
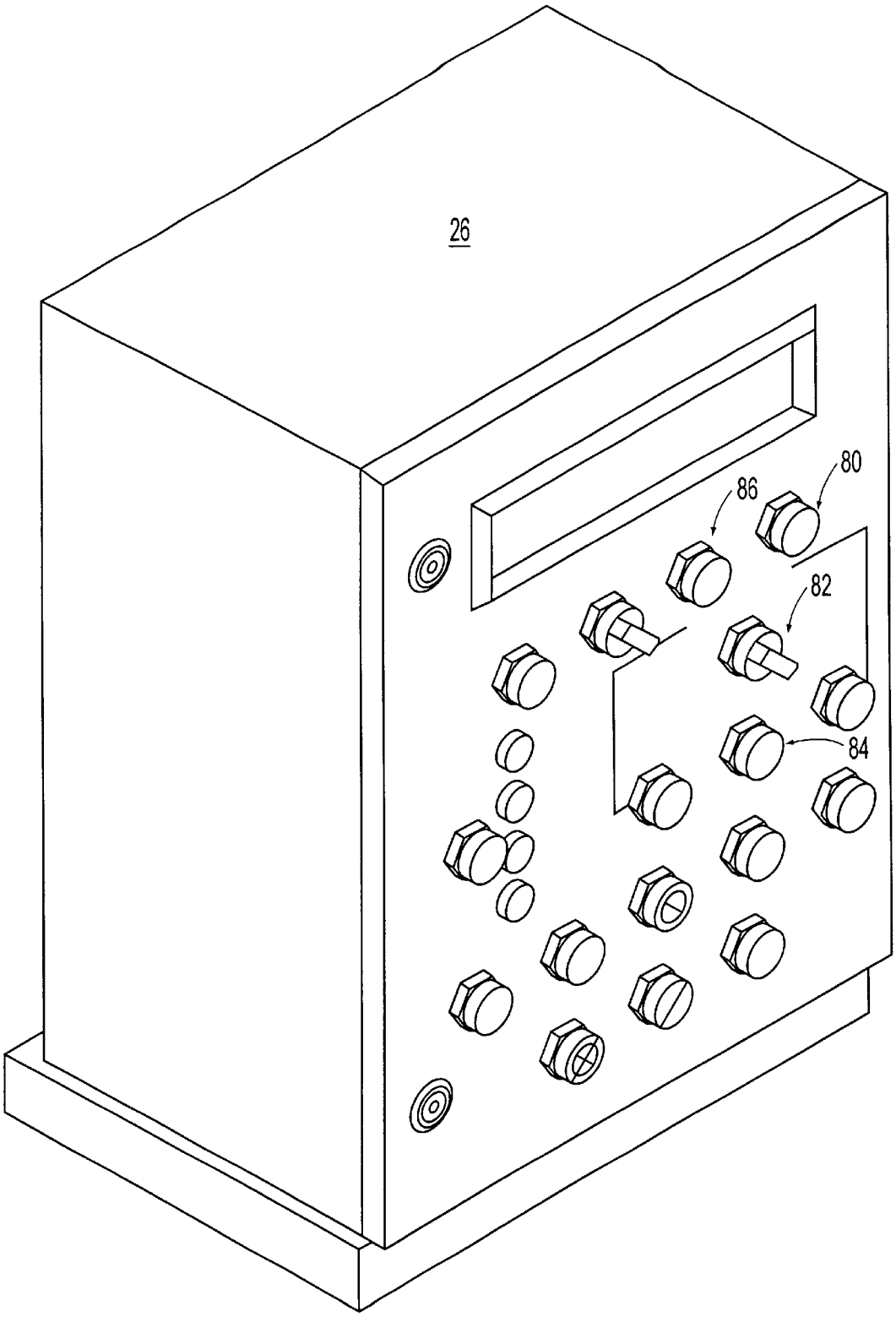
FIG. 4 is a perspective view of the servo controller unit of the apparatus of FIG. 1.

Looking at FIG. 4, it can be understood that numerous buttons on the servo controller unit 26 allow a user to establish the apparatus 10 parameters for a specific job. Among the numerous buttons is a START button 80 which will begin operation of the apparatus 10. It should be noted that once the START button 80 is engaged, the apparatus 10 will "home" itself before beginning operation. In addition, certain buttons may be used to increase or decrease the speed or position of the function selected. For example, while the apparatus 10 is running, a user may wish to increase the rotation speed of the drums. In order to do this, the user merely needs to identify the function desired to be adjusted and engage the designated buttons which will incrementally adjust the selected function, in this example, the speed, until the function performs at the desired level.

Returning to FIG. 1, it can be understood that the servo controller unit 26 is also connected 41 to the printing roller 76 electrically, mechanically, digitally or by any other method. The connection 41 provides the servo controller unit 26 with the ability to incrementally adjust the location of the printing roller 76 with respect to the rotating printing drum 22, the speed of rotation of the printing roller, or the location and speed of rotation to change the amount of indicia that is transferred to the pellet shaped articles 12. For example, a fine-coarse feature 84 of the servo controller unit 26 can establish the distance that the printing roller 76 will move when an Advance (+)/Retard(−) button 86 is engaged. When so desired, the printing roller 76 can be advanced in the same direction as its travel, i.e., toward the printing drum 22, or opposite its direction of travel, i.e., away from the printing drum 22.

Now, looking at FIGS. 5(*a*)–(*c*), the relationship between the placement of the printing roller 76 and the length of the printed band of indicia on the pellet shaped articles 12 will be explained further.

The articles 12 are maintained in their respective pockets 42 by the holding force of the vacuum source 70. However, since the vacuum source 70 is not necessarily controlled by the servo controller unit 26 and the holding force is constant, manipulating the degree of contact between the printing roller 76 and the vacuum retained article 12 allows for a precise amount of indicia to be printed onto the article 12. Also, the speed of rotation of the printing roller 76, and consequently the article 12, can be adjusted while the apparatus 10 is running or "on the fly." The precise positioning of the printing roller 76 can be adjusted by the servo controller unit 26 to set the amount of frictional pressure necessary to be applied to the articles 12 so that the articles 12 will rotate and a band of indicia printed thereon. If desired, the printing roller 76 positioning and hence the amount of frictional pressure can be set such that the band of indicia completely encompasses the article 12.

Figure 5A:
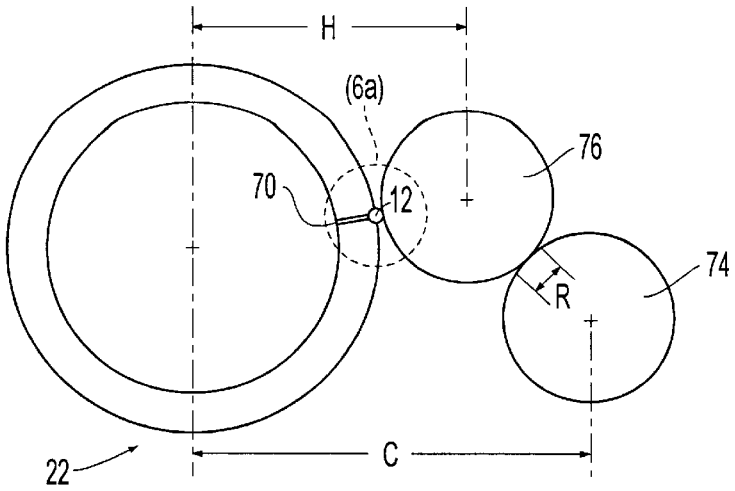
FIGS. 5 (*a*)–(*c*) are schematic views of the design roller, printing roller and printing drum of the apparatus of FIG. 1, illustrating the relationship between the placement of the printing roller and the length of the printed band of indicia.
Figure 5B:
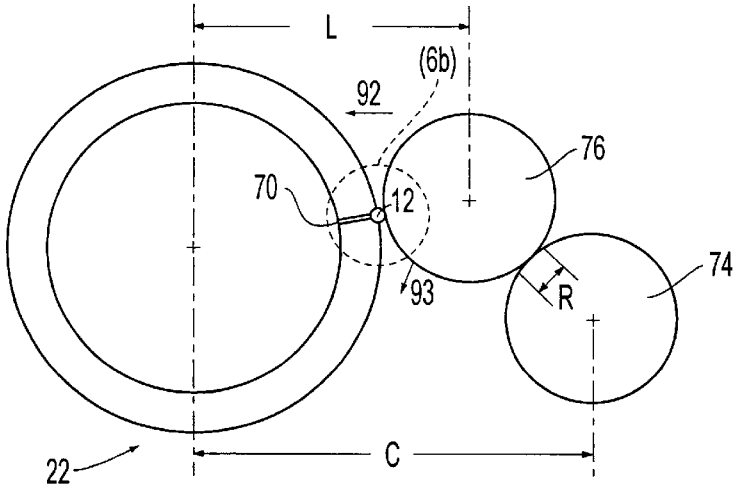
Figure 5C:
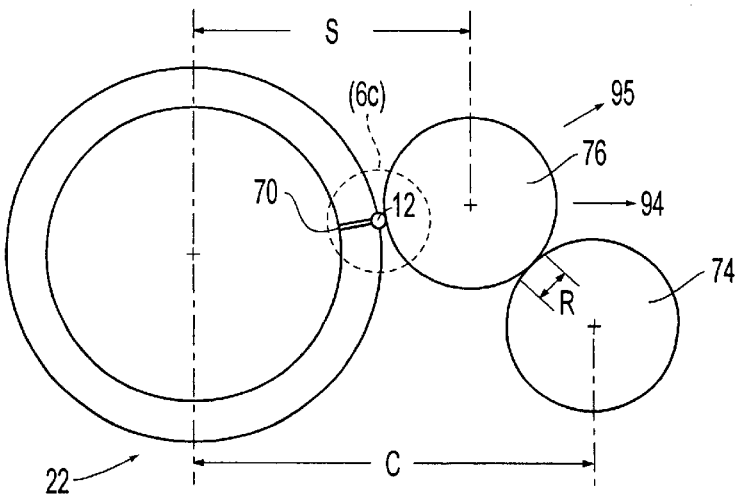

As shown in FIG. 5(*a*), the printing roller 76 is in its home position, where the distance H represents a standard predetermined amount. The pressure between the printing roller 76 and the printing drum 22 is a predetermined, standard amount when the printing roller is in the home position. Although the printing drum and design roller rotate, because they do not move in axial or radial directions relative to their respective shafts, it can also be appreciated that the distance C between the design roller 74 and the printing drum 22 remains constant. This is true except for the apparatus configuration where the design roller 74 moves with the printing roller 76.

Figure 6A:
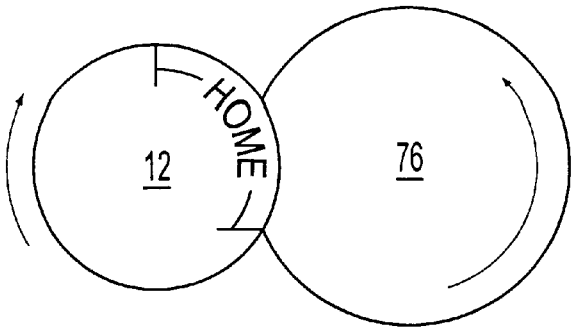
FIGS. 6 (*a*)–(*c*) depict examples of the relationship in FIGS. 5(a)–(c) in enlarged views.
Figure 6B:
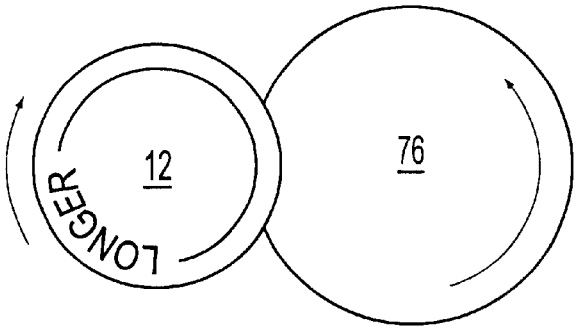
Figure 6C:
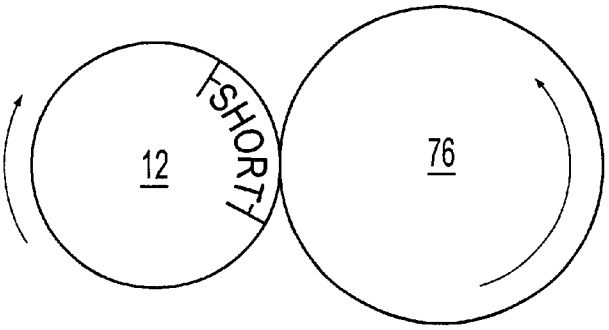
Figure 7A:
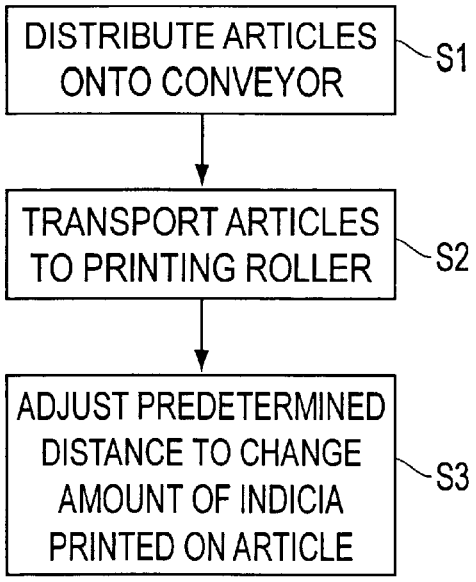
FIGS. 7 (*a*)–(*d*) depict flowchart diagrams for methods of rectifying, orienting, and printing indicia onto pellet shaped pharmaceutical articles using the apparatus of FIG. 1.
Figure 7C:
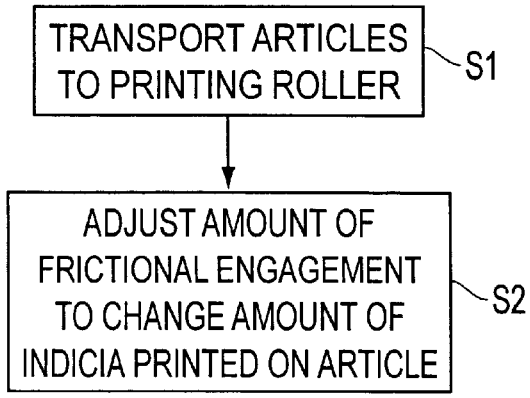
Figure 7B:
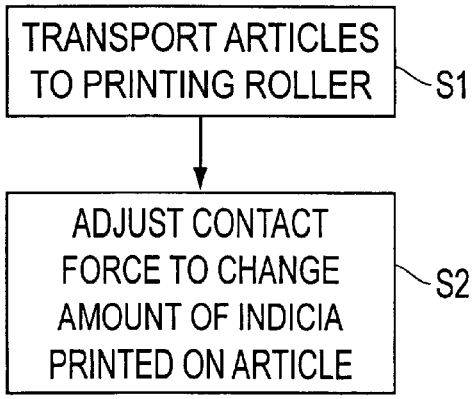
Figure 7D:
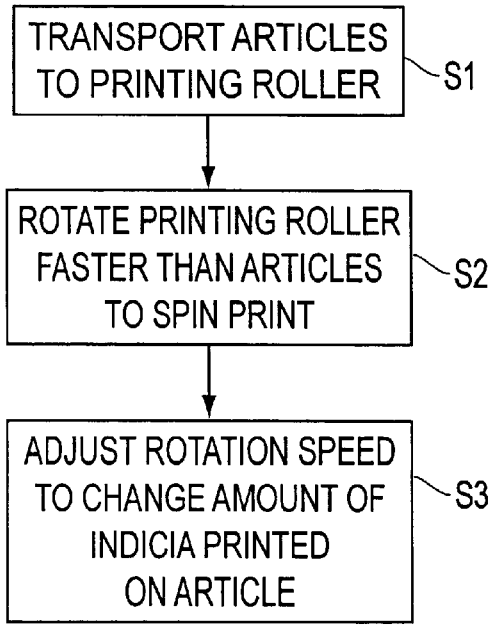

Now turning to FIG. 6(*a*), an example of an article 12 being spin printed upon while the printing roller 76 is positioned in the home setting will be described. As discussed above, the article 12 is maintained in its respective pocket 42 by a constant holding force from a vacuum source 70 within the printing drum 22. The article 12 is consequently rotating very little, if at all. The printing roller 76 is rotating faster than the printing drum 22 such that when the printing roller 76 makes contact with the article 12, a frictional pressure is applied to the article 12. The article 12 is then forced to rotate within its pocket 42 and against the holding force, while simultaneously indicia is transferred from the printing roller 76 to the rotating, or spinning, article 12. The length of the band of indicia directly corresponds to the amount of contact the printing roller 76 has with the article 12. The closer the printing roller 76 is to the printing drum 22, the more contact it will have with the article 12 and the longer the band of indicia.

Now looking at FIG. 5(*b*), an example of when the distance between the printing roller 76 and the printing drum 22 is shortened relative to the standard predetermined distance H will be described, to increase the length of the band printed. For example, to have the band of indicia printed completely around the article 12, the printing roller 76 will be advanced toward the printing drum 22 as indicated by the arrow 92 such that distance L is less than the distance H discussed above. In addition to moving the printing roller 76 closer to the printing drum 22 in the direction indicated by arrow 92, the printing roller 76 is also moved toward the printing drum 22 in a direction indicated by arrow 93. Thus, looking at FIGS. 5(*a–c*) it can be seen that the printing roller 76 maintains a constant amount of contact R with the design roller 74 at all times. In other words, regardless of the length of the indicia to be transferred to the pellet shaped articles, the printing roller 76 and design roller 74 will always contact each other the same amount R. This assures that the amount of indicia to be transferred to the articles 12 will not be affected by the positioning of the printing roller 76. Yet, moving the printing roller 76 closer to the printing drum 22 will increase the amount of contact the printing roller 76 has with the articles 12 within the printing drum 22. As can be seen in FIG. 6(*b*), the increase in the amount of contact leads to a longer band of indicia being printed onto the circumference of the article 12.

The printing roller 76 is moved closer to the printing drum 22 by advancing the Advance/Retard button 86 on the servo controller unit 26 once the fine-coarse feature 84 has been selected. Engaging the Advance/Retard button 86 will incrementally move the printing roller 76 a predetermined or user-determined amount, thereby increasing the amount of contact between the printing roller 76 and the printing drum 22. Also, because the printing roller 76 rotates faster then the printing drum 22, the article 12 will spin faster within its pocket 42. Therefore, the circumference of the article 12 is more completely and quickly exposed to the printing roller 76, thereby resulting in a band of indicia, for example, being imprinted onto the article 12 completely around the circumference of the article 12, as shown in FIG. 6(*b*).

Now looking at FIG. 5(*c*), an example of when the band of indicia is desired to be shorter than the Home setting will be described. To decrease or shorten the band of indicia, the printing roller 76 is moved away from the printing drum 22 in a direction indicated by the arrow 94, increasing the distance S between the printing roller 76 and printing drum 22 such that distance S is more than distance H discussed above, thereby decreasing the amount of contact the printing roller 76 has with the articles 12. This results in a decrease in the amount of pressure being applied to the articles 12 from the printing roller 76. Therefore, the band of indicia printed on each article 12 is shorter, as shown in FIG. 6(*c*).

As can be appreciated in view of the above discussion, various buttons on the servo controller unit 26 can be designated for printing indicia on the articles 12 in predetermined circumferential amounts, e.g., one button for 90° printing, another button for about 120° printing, and other buttons for increments covering printing over a range of about 121°–360°.

FIGS. 7(*a*)–(*d*) explain different methods, aspects of which are combinable, in using the apparatus for orienting, positioning and spin printing indicia onto pellet shaped articles 12.

Looking at FIG. 7(*a*), step 1 of the method entails distributing the pellet shaped articles 12 onto a moving conveyor. The conveyor comprises at least the printing drum 22 and possibly additional drums. Step 2 involves transporting the pellet shaped articles 12 to a printing roller 76 positioned a predetermined distance H from the conveyor. Step 3 includes adjusting the predetermined distance H of the printing roller 76 to the conveyor, thereby changing the amount of indicia printed onto the pellet shaped articles 12.

FIG. 7(*b*) depicts another method in using the apparatus. Step 1 of the method involves transporting the pellet shaped articles 12 to a printing roller 76 that transfers indicia to the pellet shaped articles under a contact force. Step 2 entails adjusting the contact force to change the amount of indicia transferred to the circumference of the pellet shaped articles.

FIG. 7(*c*) shows yet another method in using the apparatus. Step 1 of the method entails transporting the pellet shaped articles 12 to the printing roller 76 that transfers an amount of indicia onto the entire circumference of the pellet shaped articles 12 by frictionally engaging the pellet shaped articles 12. Step 2 includes adjusting the amount the printing roller 76 frictionally engages the pellet shaped articles 12 to change the amount of indicia transferred to the pellet shaped articles 12.

FIG. 7(*d*) depicts another method in using the apparatus. Step 1 involves transporting the pellet shaped articles 12 to the printing roller 76. Step 2 includes rotating the printing roller 76 faster than the pellet shaped articles 12, thereby transferring an amount of indicia onto the entire circumference of the pellet shaped articles 12. Step 3 entails adjusting the speed of the printing roller 76 relative to the various drums/conveyor to change the amount of indicia transferred to the pellet shaped articles 12. In this embodiment, the servo controller could also be any suitable variable drive device that is capable of adjusting the speed of the printing roller relative to the speed of the conveyor/printing drum.

The various methods described above also have aspects that are combinable with one another. For example, the servo controller unit or other suitable controller can be used to change the distance between the primary drum and printing roller, as well as change the speed of the printing roller with respect to the printing drum.

Figure 8:
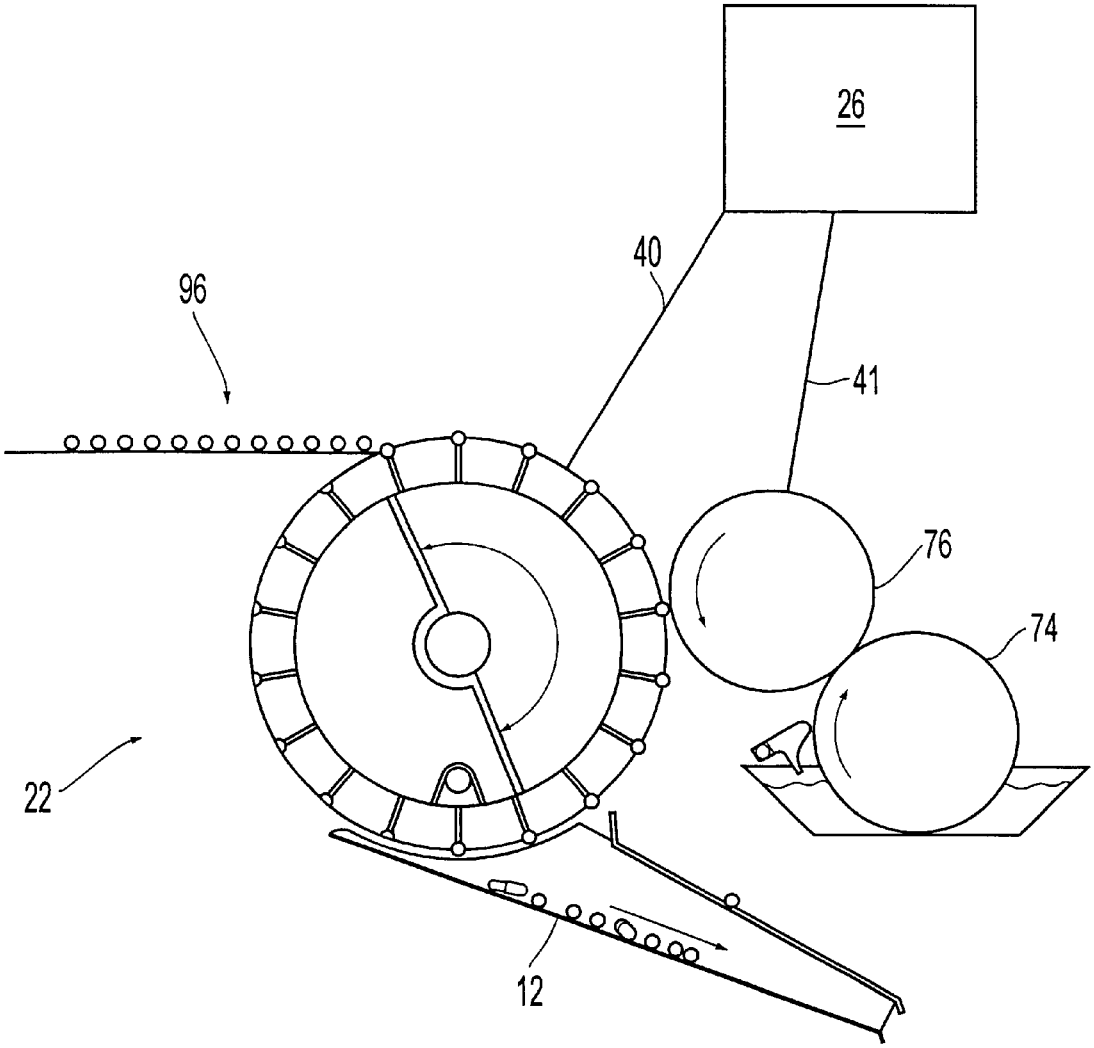
FIG. 8 is a perspective view of the spin printing apparatus in a second embodiment according to the invention.

In other aspects of the invention, the articles 12 may be arranged in a predetermined order 96 prior to being fed to the printing drum 22. Looking at FIG. 8, it can be understood that when the articles 12 are in a predetermined order, e.g., longitudinally placed in the pockets 42 of the printing drum 22, the pick-up drum 18 and positioning drum 20 are not needed. This arrangement may be suitable for caplets as well as capsules because no rectifier 50 is necessary. Additionally, the servo controller unit 26 may be connected 40 and 41 to the printing drum 22 and the printing roller 76 using line 41 and 42 mutually exclusive of each other. Alternatively, the servo controller unit 26 may be connected (not shown) to both via the same connection.

Also, the articles 12 may first pass through a drilling station 90 where a mechanical time-release mechanism is created. See FIG. 9. The time-release mechanism is formed by creating a depression or hole in the coating of the article 12 with a laser or other drilling device so saliva and assorted body acids interact with the chemical composition within the article 12. This allows certain portions of the interior of the articles 12 to be immediately exposed to the stomach and absorbed into the bloodstream when ingested. This feature is more fully described in U.S. Pat. No. 5,367,771 to Roy, the subject matter of which is incorporated herein by reference. From the drilling station 90, the articles 12 are transported to the feeding station 14 as indicated by the arrow.

Figure 10:
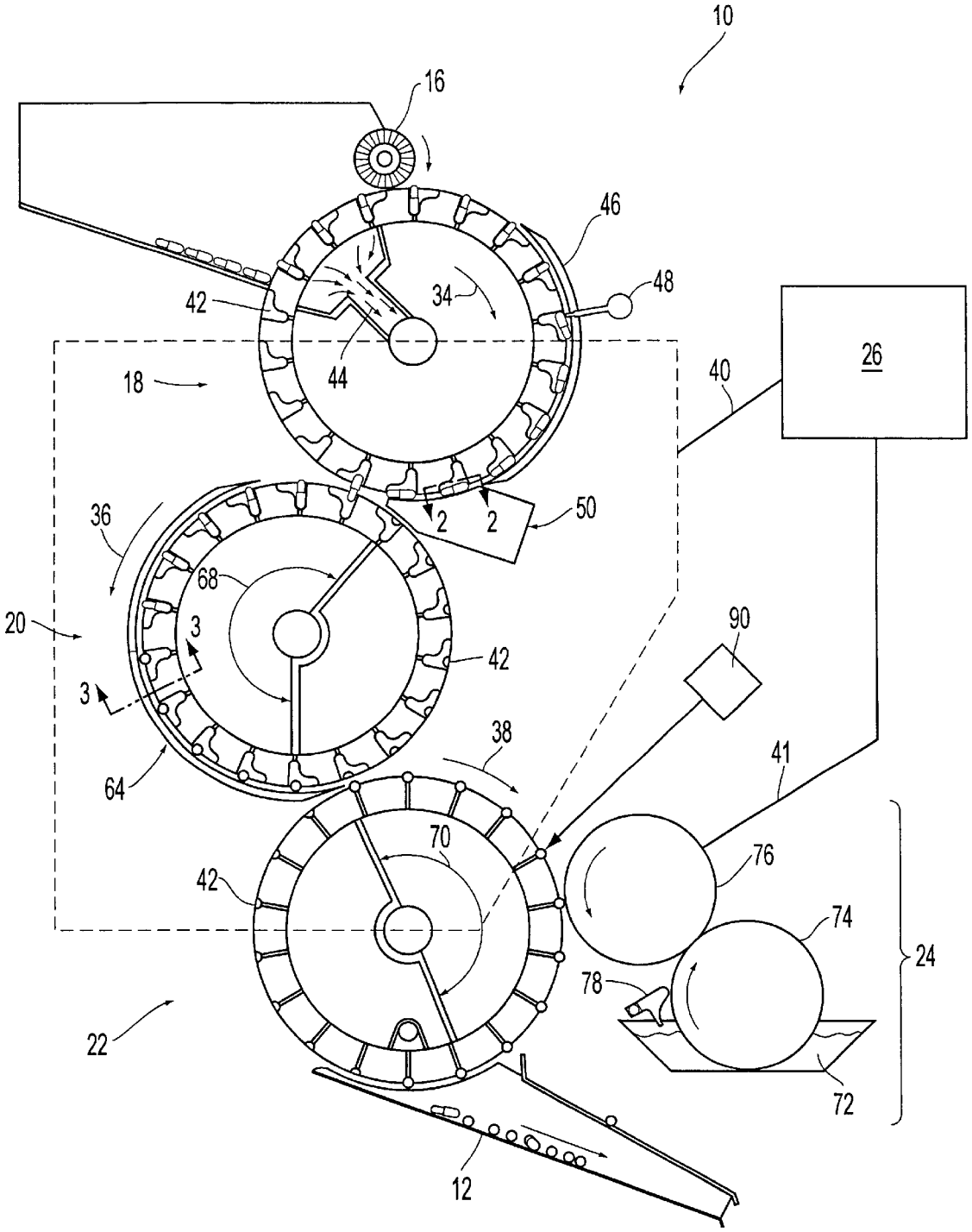
FIG. 10 is a perspective view of the spin printing apparatus in a fourth embodiment according to the invention.

Optionally, it may be desirous to conceal the depression or hole using the printing station 24. Therefore, the drilling station 90 may be located between the feeding station 14 and the printing station 24 with the servo controller unit 26 positioning the printing roller 76 so that the band of indicia spin printed onto the article 12 conceals the hole or depression. See FIG. 10. Of course, the drilling station 90 can be located downstream of the printing station 24 depending on the desired appearance of the final product.

While the invention has been described in conjunction with the specific embodiments thereof, it is evident that many alternatives, modifications, and variations may be apparent to those skilled in the art. Also, while many components and/or method aspects are described above in cooperative association, each component and/or method aspect may form an independent aspect of the invention separately useable from the other aspects of the invention. Accordingly, the preferred embodiment of the invention as set forth herein is intended to be illustrative, not limiting. Various changes may be made without departing from the spirit and scope of the present discussion.

What is claimed is:

1. A spin printing apparatus, comprising:

a conveyor including a plurality of pockets that receive a plurality of pellet shaped articles;

a printing roller spaced from the conveyor at a predetermined distance, the printing roller contact-printing indicia on each of the pellet shaped articles; and a device that adjusts the predetermined distance to change a length of a band of the indicia printed on the pellet shaped articles.

2. The apparatus of claim 1 wherein the conveyor comprises a printing drum rotatably communicating with the printing roller, the printing drum having a vacuum source that maintains the pellet shaped articles within the plurality of pockets by drawing air into the plurality of pockets such that the pellet shaped articles are spin printed when the pellet shaped articles contact the printing roller.

3. The apparatus of claim 2 further comprising a feeding station configured to distribute the plurality of pellet shaped articles onto the printing drum.

4. The apparatus of claim 2 wherein the conveyor further comprises a pick-up drum and a positioning drum, the pick-up drum and positioning drum each having a plurality of pockets that receive the plurality of pellet shaped articles, the pick-up drum rotatably communicating with and receiving the pellet shaped articles from a feeding station, the positioning drum rotatably communicating with and receiving the pellet shaped articles from the pick-up drum, the printing drum rotatably communicating with and receiving the pellet shaped articles from the positioning drum.

5. The apparatus of claim 2 further comprising a design roller defining a pattern of indicia, wherein the printing roller comprises a smooth, blank surface, the printing roller being movable toward and away from the printing drum, the printing roller being positioned between the printing drum and the design roller so that the printing roller transfers the pattern of indicia from the design roller to the pellet shaped articles.

6. The apparatus of claim 1 wherein the device comprises a servo controller unit connected to the printing roller, the servo controller unit controlling the predetermined distance between the printing roller and the conveyor, wherein, when the printing roller is positioned closer to the conveyor than the predetermined distance, the amount of indicia printed on the pellet shaped articles increases, and when the printing roller is positioned farther from the conveyor than the predetermined distance, the amount of indicia printed on the pellet shaped articles decreases.

7. The apparatus of claim 1 wherein the device comprises a servo controller unit connected to the conveyor, the servo controller unit controlling the predetermined distance between the conveyor and the printing roller, wherein, when the predetermined distance decreases, the amount of indicia printed on the pellet shaped articles increases, and when the predetermined distance increases, the amount of indicia printed on the pellet shaped articles decreases.

8. The apparatus of claim 1 wherein the pellet shaped articles comprise at least one of capsules and caplets.

9. The apparatus of claim 1 wherein the indicia printed on each of the pellet shaped articles encompasses a range of 0° to 360° of a circumference of each of the pellet shaped articles.

10. A spin printing apparatus, comprising:

a conveyor including at least one pocket for receiving a pellet shaped article;

a printing roller adjacent the conveyor, the printing roller providing a predetermined amount of indicia to the pellet shaped article under a selected contact force; and a device that adjusts the selected contact force to change a length of a band of the predetermined amount of indicia.

11. The apparatus of claim 10 wherein the conveyor further comprises a pick-up drum and a positioning drum, the pick-up drum and positioning drum each having at least one pocket to receive the pellet shaped article, the pick-up drum rotatably communicating with and receiving the pellet shaped article from a feeding station, the positioning drum rotatably communicating with and receiving the pellet shaped article from the pick-up drum, and a printing drum rotatably communicating with and receiving the pellet shaped article from the positioning drum.

12. The apparatus of claim 11 further comprising a design roller defining a pattern of indicia, the printing roller comprising a smooth, blank surface, the printing roller being movable toward and away from the printing drum, the printing roller being positioned between the printing drum and the design roller so that the printing roller provides the predetermined amount of indicia to the pellet shaped article under the selected contact force.

13. The apparatus of claim 10 wherein the device comprises a servo controller unit connected to one of the printing roller and the conveyer.

14. The apparatus of claim 10 wherein the indicia printed on each pellet shaped article encompasses a range of 0° to 360° of a circumference of each pellet shaped article.

15. A spin printing apparatus, comprising:

a conveyor including at least one pocket for receiving at least one of a caplet and a capsule having a circumference;

a printing roller frictionally engaging the caplet or capsule a predetermined amount to selectively print an amount of indicia along an entire circumference of the caplet or capsule; and a device that adjusts the predetermined amount the printing roller frictionally engages the caplet or capsule to selectively print a band of indicia along the entire circumference of the caplet or capsule.

16. The apparatus of claim 15 wherein the device adjusts a speed of rotation of the printing roller to change an amount of indicia transferred to a circumference of the caplet or capsule.

17. The apparatus of claim 15 wherein the device adjusts a predetermined distance of the printing roller to the conveyor, thereby changing an amount of indicia transferred to a circumference of the caplet or capsule.

18. The apparatus of claim 15 wherein the device adjusts at least one of a speed of rotation of the printing roller and a predetermined distance of the printing roller to the conveyor to change an amount of indicia transferred to a circumference of the caplet or capsule.

19. The apparatus of claim 15 wherein the conveyor further comprises a pick-up drum and a positioning drum, the pick-up drum and positioning drum each have at least one pocket to receive the caplet or capsule, the pick-up drum rotatably communicating with and receiving the caplet or capsule from a feeding station, the positioning drum rotatably communicating with and receiving the caplet or capsule from the pick-up drum, and a printing drum rotatably communicating with and receiving the caplet or capsule from the positioning drum.

20. The apparatus of claim 19 further comprising a design roller defining a pattern of indicia, the printing roller comprising a smooth, blank surface, the printing roller being movable toward and away from the printing drum, the printing roller being positioned between the printing drum and the design roller so that the printing roller frictionally engage the caplet or capsule the predetermined amount to selectively print the standard amount of indicia along the entire circumference of the capsule.

21. A method for spin printing pellet shaped articles, comprising:

distributing the pellet shaped articles on a moving conveyor;

transporting the pellet shaped articles to a printing roller positioned a predetermined distance from the conveyor; and adjusting the predetermined distance of the printing roller to the conveyor, thereby changing a length of a band of indicia printed onto the pellet shaped articles.

22. A method for spin printing pellet shaped articles, comprising:

transporting the pellet shaped articles to a printing roller that transfers indicia to the pellet shaped articles under a contact force; and adjusting the contact force to change a length of a band of indicia transferred to a circumference of the pellet shaped articles.

23. A method for spin printing indicia onto pellet shaped articles, comprising:

transporting the pellet shaped articles to a printing roller that transfers an amount of indicia onto an entire circumference of the pellet shaped articles by frictionally engaging the pellet shaped articles; and adjusting a length the printing roller frictionally engages the pellet shaped articles to change a length of a band of indicia transferred to the pellet shaped articles.

24. A spin printing apparatus, comprising:

a conveyor including at least one pocket that receives at least one pellet shaped article;

a printing roller spaced from the conveyor at a predetermined distance and frictionally engaging the at least one pellet shaped article a predetermined amount, the printing roller performing contact-printing of indicia on the at least one pellet shaped article under a selected contact force; and a device that changes a length of a band of the indicia printed on the at least one pellet shaped article by adjusting at least one of the predetermined distance, the selected contact force, and the predetermined amount the printing roller frictionally engages the at least one pellet shaped article.

25. A method for spin printing pellet shaped articles, comprising:

distributing the pellet shaped articles on a moving conveyor;

transporting the pellet shaped articles to a printing roller positioned a predetermined distance from the conveyor that frictionally engages the pellet shaped articles and transfers an amount of indicia to the pellet shaped articles under a contact force; and changing a length of a band of the indicia printed on the pellet shaped articles by adjusting at least one of the predetermined distance, the contact force, and an amount the printing roller frictionally engages the pellet shaped articles.

* * * * *